US008800544B2

(12) United States Patent
Newsom et al.

(10) Patent No.: US 8,800,544 B2
(45) Date of Patent: Aug. 12, 2014

(54) OVEN DOOR LOCKING SYSTEM

(75) Inventors: Paul Newsom, Louisville, KY (US); Paul Bryan Cadima, Louisville, KY (US)

(73) Assignee: General Electric Company, Schenectady, NY (US)

( * ) Notice: Subject to any disclaimer, the term of this patent is extended or adjusted under 35 U.S.C. 154(b) by 826 days.

(21) Appl. No.: 13/008,359

(22) Filed: Jan. 18, 2011

(65) Prior Publication Data

US 2012/0180776 A1 Jul. 19, 2012

(51) Int. Cl.
*F24C 15/02* (2006.01)

(52) U.S. Cl.
USPC ..... 126/197; 126/191; 126/192

(58) Field of Classification Search
CPC ..... F24C 15/022; F24C 15/02; F24C 15/028
USPC ..... 126/197, 191, 192
See application file for complete search history.

(56) References Cited

U.S. PATENT DOCUMENTS

| | | | | |
|---|---|---|---|---|
| 3,214,567 | A * | 10/1965 | Chisholm | 219/413 |
| 3,561,421 | A * | 2/1971 | Body et al. | 126/21 R |
| 3,815,942 | A * | 6/1974 | White | 292/113 |
| 5,517,006 | A | 5/1996 | Fredriksson | |
| 6,829,123 | B2 * | 12/2004 | Legatti et al. | 361/1 |

* cited by examiner

*Primary Examiner* — Avinash Savani
(74) *Attorney, Agent, or Firm* — Global Patent Operation; Douglas D. Zhang

(57) ABSTRACT

A locking system for an appliance that includes an oven and a door for the oven. The locking system includes an oven door lock device that is selectively switchable between a locked position and an unlocked position, a flame sensor configured to detect a flame within the oven, and a controller communicatively coupled to the flame sensor. The controller is configured to switch the oven door lock device to its locked position thereby securing the door in its closed position when a flame inside the oven is detected.

11 Claims, 4 Drawing Sheets

OVEN DOOR LOCKING SYSTEM

BACKGROUND OF THE INVENTION

The present disclosure generally relates to appliances, and more particularly to a locking system for a door of an oven.

In an oven, there is the possibility of an open fire within the oven cavity. If there is a fire in the oven and the oven door is opened, fresh combustion air is allowed to enter into the oven cavity. The addition of fresh air into the oven cavity will feed the fire. This can increase the intensity of the fire, potentially causing damage to the oven unit and surroundings.

However, most oven cavities are designed to be able withstand high temperatures. Additionally, the doors tend to have heat resistance gaskets and when the door is closed, the amount of air entering into the oven cavity is limited. Thus, generally when the oven door is closed, any fire within the oven cavity can be controlled. However, should the door be opened in an attempt to put the fire out, the fire may escape the oven cavity.

It would be advantageous to be able to detect a flame or fire within an oven cavity, and automatically and quickly lock the oven door to prevent the oven door from being opened. Although some ovens are equipped with automatic or motorized locking mechanisms, these locking mechanisms typically take a number of seconds to engage and the oven door could be opened during this time period. It would be advantageous to be able to utilize a locking system that can respond quickly to the detection of a flame within the oven cavity. Accordingly, it would be desirable to provide a system and apparatus that addresses at least some of the problems identified above.

BRIEF DESCRIPTION OF THE INVENTION

As described herein, the exemplary embodiments overcome one or more of the above or other disadvantages known in the art.

One aspect of the exemplary embodiments relates to a locking system for an appliance that includes an oven and a door for the oven. In one embodiment, the system includes an oven door lock device that is selectively switchable between a locked position and an unlocked position, the oven door lock device being operative in its locked position to engage and secure the door in its closed position and in its unlocked position to permit movement of the door from its closed position, a flame sensor configured to detect a flame within the oven, and a controller communicatively coupled to the flame sensor. The controller is configured to switch the oven door lock device to its locked position when a flame inside the oven is detected.

These and other aspects and advantages of the exemplary embodiments will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and unless otherwise indicated, they are merely intended to conceptually illustrate the structures and procedures described herein. In addition, any suitable size, shape or type of elements or materials could be used.

DETAILED DESCRIPTION OF THE EXEMPLARY EMBODIMENTS OF THE DISCLOSURE

Figure 1:
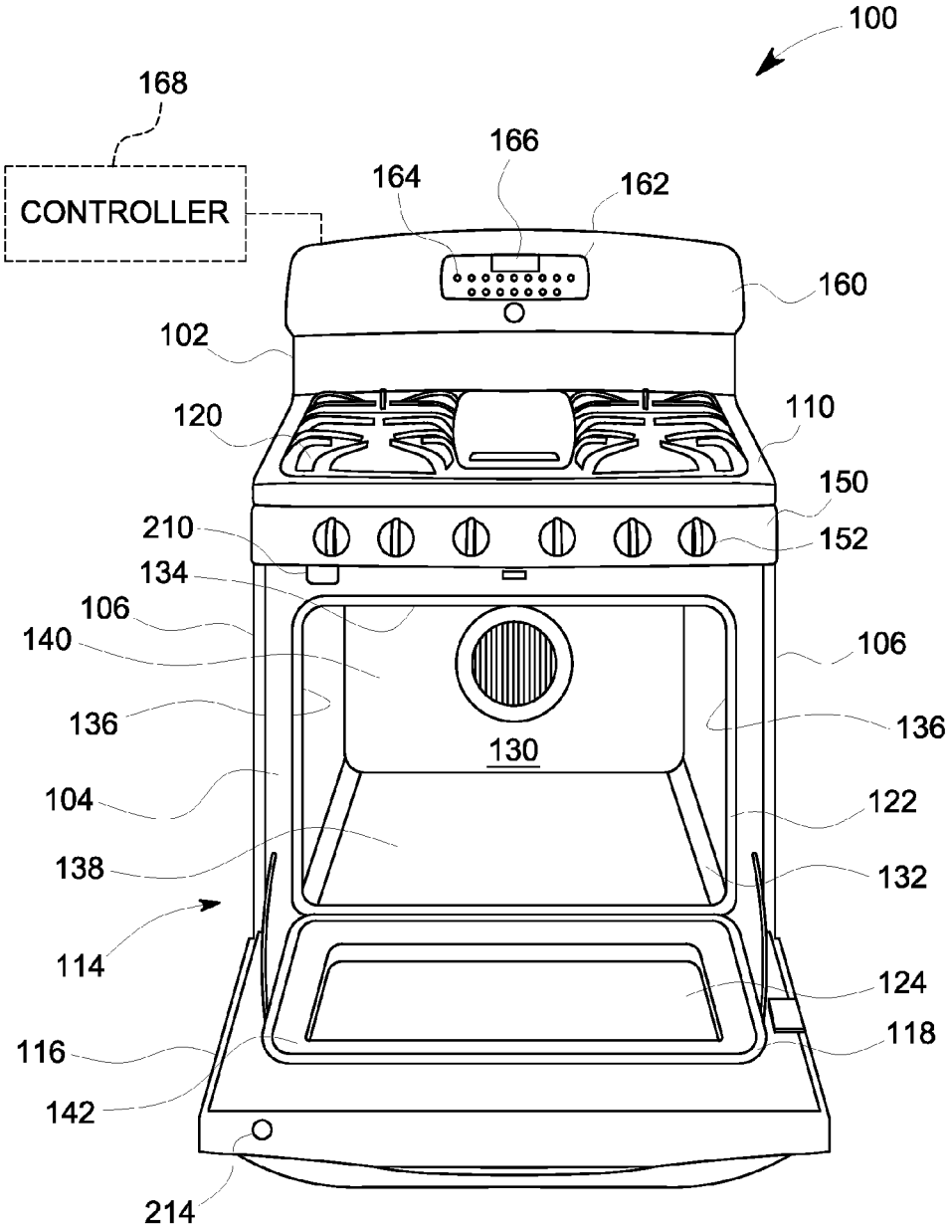
FIG. 1 is a perspective view of an exemplary range incorporating aspects of the disclosed embodiments.

Referring to FIG. 1, an exemplary appliance such as a freestanding range in accordance with the aspects of the disclosed embodiments is generally designated by reference numeral 100. The aspects of the disclosed embodiments are generally directed to detecting a flame within an oven cavity and preventing a door to the oven cavity from being opened in a quick and automatic fashion. Although a range 100 is shown in FIG. 1, the aspects of the disclosed embodiments can be applied to any appliance that includes an oven.

As is shown in FIG. 1, the range 100 includes a cabinet or housing 102 that has a front portion 104, opposing side panels 106, a base or bottom panel 108, a top panel 110, and a back panel 112. In the embodiment shown in FIG. 1, the top panel 110 of the range 100 includes a maintop or cooktop 120. The range 100 also includes an oven unit 114. In the example shown in FIG. 1, the oven unit 114 includes a front-opening access door 116. As is shown in FIG. 1, the door 116 includes a heat resistant gasket 118 that seats against a respective gasket receiving member 122 of the cabinet 102. In the example shown in FIG. 1, the oven door 116 includes a windowed portion 124 that allows the user to view an interior of the oven or oven cavity 130.

The oven cavity 130 is generally defined by the oven cavity liner 132. The oven cavity liner 132 includes a top panel 134, side walls 136, bottom panel 138, a rear wall 140 and door interior panel 142.

In one embodiment, the cabinet 102 of the range 100 includes a control surface 150 that supports one or more controls, generally referred to herein as burner controls 152. The burner control or control knob 152 shown in FIG. 1 is generally in the form of a knob style control that extends outwardly from and can be supported by the control surface 150. Although the example of FIG. 1 shows the burner control knob 152 on the front portion 104 of the cabinet 102, in alternate embodiments, the burner control knob 152 can be located in any suitable location on the cabinet 102, such as for example the backsplash 160.

As shown in FIG. 1, the back splash 160 includes a control panel 162. In one embodiment, the back splash 160 includes a plurality of input selectors or switches 164 and a display 166. In one embodiment, the control panel 162 is in cooperation with burner control knob 152 to form a user interface for selecting and displaying cooking cycles, warming cycles and/or other operating features. In one embodiment, the input selectors or switches 164 can be in the form of push buttons or electronic switches.

In one embodiment, the oven 100 includes a controller 168. The controller 168 is coupled to, or integrated within, the control panel 162 and configured to receive inputs and commands from for example, the controls 152 and 164, and control the various operations and functions of the oven 100. In one embodiment, the controller 168 can include or comprise an electronic range control, and can be used to control the activation of the oven door locking mechanism as is further described herein.

Figure 2:
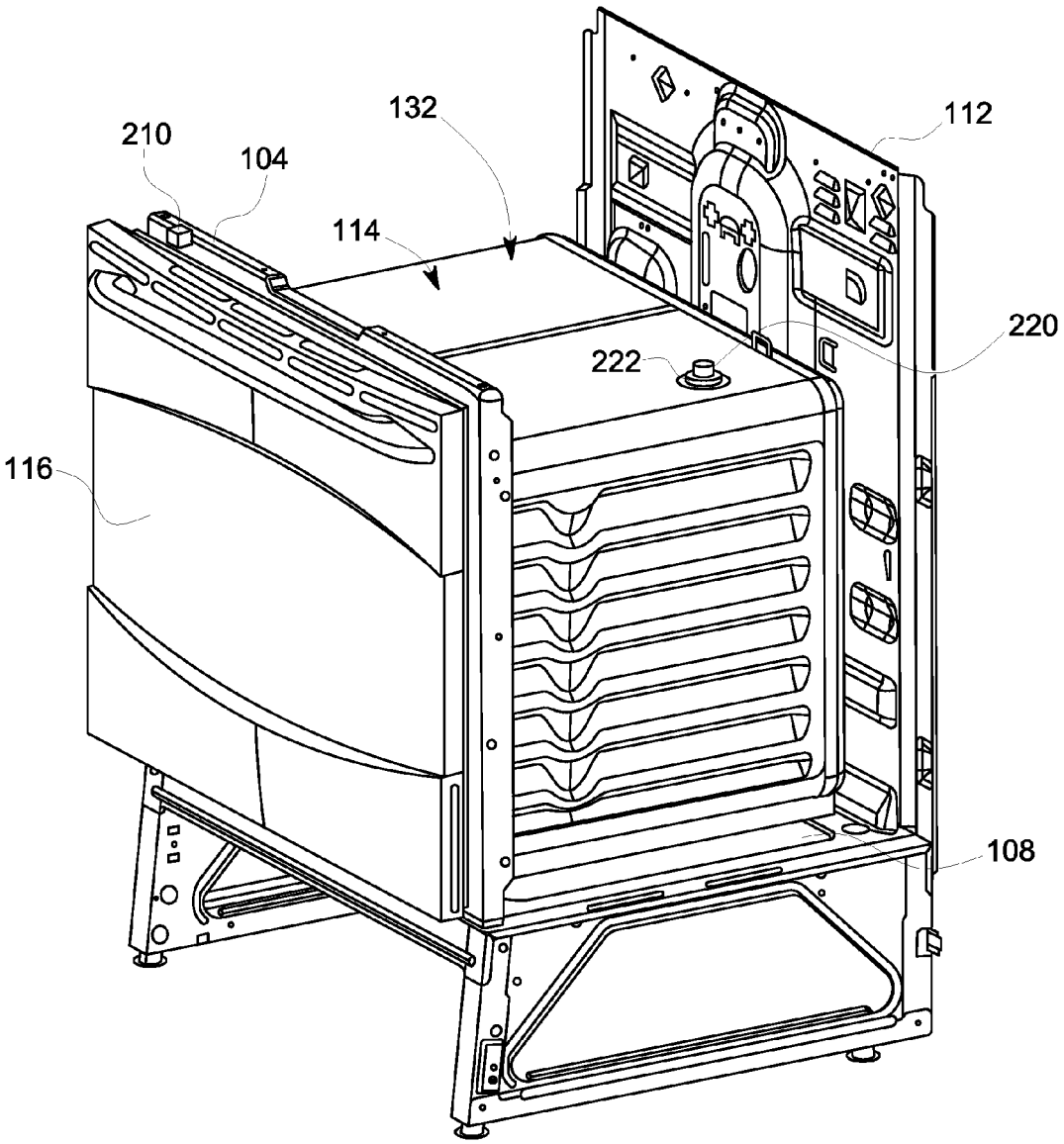
FIG. 2 is a partial assembly view of the range of FIG. 1.

FIG. 2 is a partial assembly view of the range of FIG. 1, showing the oven 114, oven liner 132 and the general locations of the oven door locking device 210 and the flame or fire sensor 220. In this example, the oven door locking device 210 is secured to the front portion 104 of the cabinet 102 and is generally configured to securely maintain the door 116 in a closed and locked state when a flame is detected within the oven cavity 130. In one embodiment, the oven door locking device 210 is a quick release locking mechanism that can automatically and quickly lock the door 116 in the closed position. This can include a standard solenoid device that holds a pin in place. One example of such an oven door locking device 210 is a standard HL 218 model solenoid manufactured by The Solenoid Company, H. Kuhnke, Ltd., Romsey, United Kingdom. Such a device will typically hold a pin or bolt in place until actuated. When actuated, the pin quickly moves into the locked position. Alternatively, the door locking device 210 can comprise any suitable device that is configured to be switchable between a locked position in which the door 116 is engaged a secured in a closed or locked position when a flame or fire is detected and an unlocked position or state, in which movement of the door is unimpeded by the locking device.

In ovens with a self-cleaning locking mechanism, the oven door locking device 210 can be a secondary oven door lock. Many ovens with a self-cleaning feature will include some type of locking device, including automatic, motorized locks, which are configured to both lock the oven door and pull the door in to create a better seal around the gasket for high temperature self clean cycles. However, these locks typically have a slow engagement period, which can be in the order of approximately 30 seconds. The oven door locking device 210 of the disclosed embodiments is configured to work independently of such a self-cleaning oven door lock, and the oven door locking device 210 will engage the door 116 very quickly upon detection of a flame or fire. The engagement time for the oven door locking device 210 of the disclosed embodiments can be on the order of approximately one-tenth of a second to two seconds. In alternate embodiments, the engagement time can be any suitable time period that allows the oven door 116 to be secured rapidly after detection of a flame in order to prevent a user from prematurely opening the oven door 116 during a flame or fire condition. It is understood that the locking device 210 can be included both in ovens with self-cleaning locking mechanisms, as a secondary lock, and in ovens without self-cleaning locking mechanisms, as a primary lock.

FIG. 2 illustrates one embodiment of the placement of a flame or fire sensor 220 with respect to the oven cavity 130. The sensor 220 is generally configured to detect a flame within the oven cavity 130. In one embodiment, the sensor 220 is a flame detection sensor, such as an infrared (IR) or ultraviolet (UV) sensor. In alternate embodiments, any suitable flame or fire detection sensor can be used. The sensor 220 is generally configured to be disposed within the oven cavity 130 or in close proximity to the interior of the oven cavity 130. For example, in one embodiment, the sensor 220 can be mounted to or disposed on one of the walls of the liner 132 that defines the oven cavity 130. It is a feature of the disclosed embodiments to quickly detect a flame or fire within the oven cavity 130.

In one embodiment, as shown in the example of FIG. 2, the sensor 220 can be mounted remotely from the interior of the oven cavity 130. In this case, the energy being transmitted from the interior of the oven cavity 130, generally in the form of ultraviolet or infrared radiation, can be carried through a suitable light pipe 222 from the interior of the oven cavity 130 to a position outside the oven cavity 130 where the sensor 220 is located. Generally, the position outside the oven cavity 130 is sufficient to maintain the sensor 220 in a relative cool environment, or an environment where the sensor 220 is not subject to or susceptible to the effects of the heat of the oven cavity 130.

The sensor 220 is generally configured to detect the presence of a flame or fire within the oven cavity 130 and generate a suitable signal. In one embodiment, the sensor 220 can transmit the signal directly to the door locking device 210 and cause the door locking device 210 to retain the door 116 in a closed and locked state. Alternatively, the signal can be received in the controller 168 where it is processed, and a suitable door locking enable command is transmitted to the door locking device 210 cause the door 116 to be secured or locked in the closed position.

Figure 3:
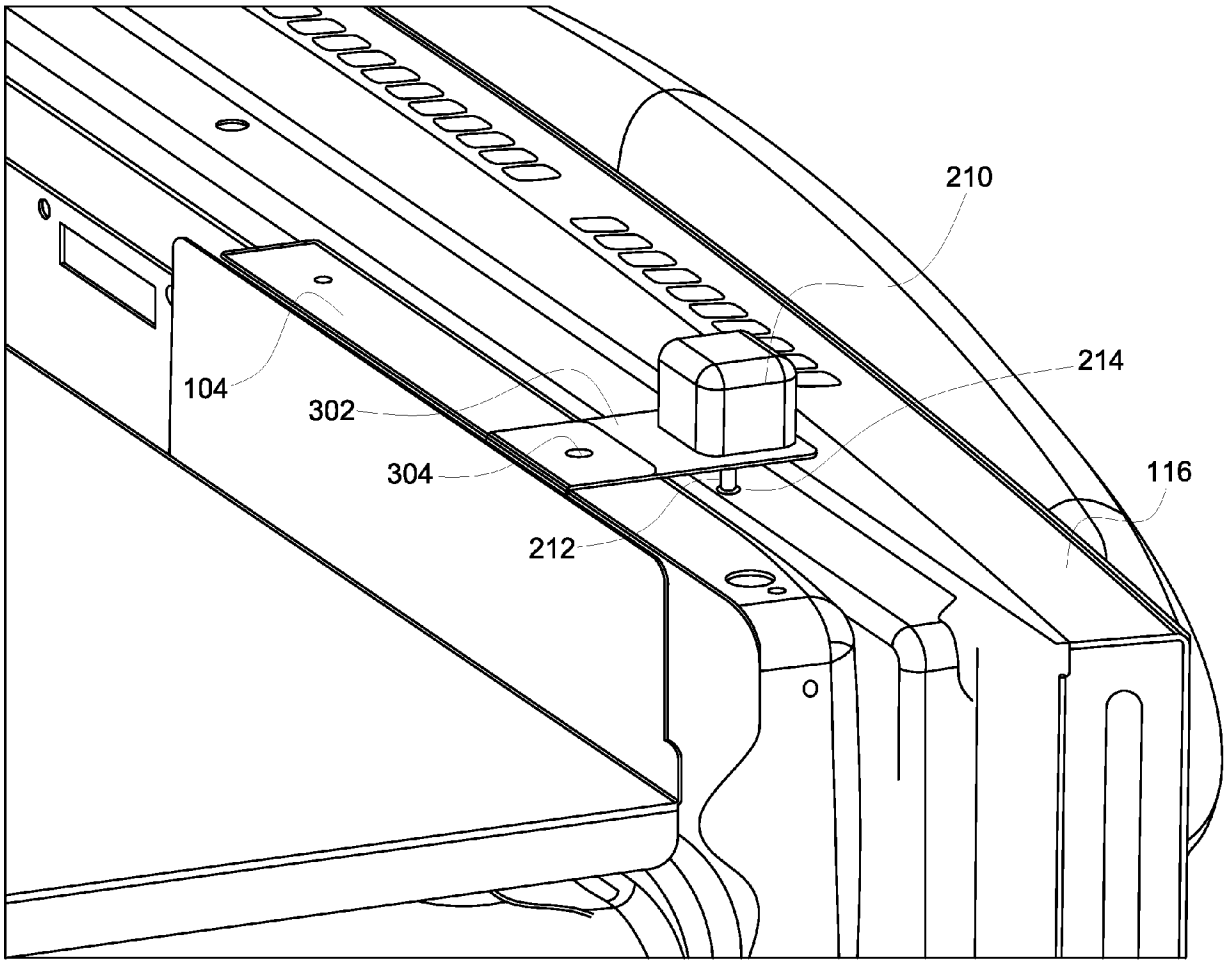
FIG. 3 is a perspective view of a locking mechanism for a range incorporating aspects of the disclosed embodiments.

Referring to FIG. 3, in an embodiment where the door locking device 210 is a pin style locking device, if a flame or fire is detected, the locking device is switched to its locked position by moving or dropping pin 212 into a receiver 214 in the door 116. The pin 212 in the receiver 214 prevents the door 116 from being opened until the pin 212 is disengaged from the receiver 214. Although a pin style locking device is generally described herein, in alternate embodiments any suitable locking device for retaining an oven door in a closed position can be used.

As is shown in FIG. 3, in this example, the oven door locking device 210 is secured to a mounting bracket 302. The mounting bracket 302 is secured to the front portion 104 of the cabinet 102 by a fastener 304. In alternate embodiments, the oven door locking device 210 can be secured to any suitable portion of the cabinet 102 of the oven 100 so that the oven door locking device 210 can retain the oven door 116 is a closed and secured position when the oven door locking device 210 is enabled.

Figure 4:
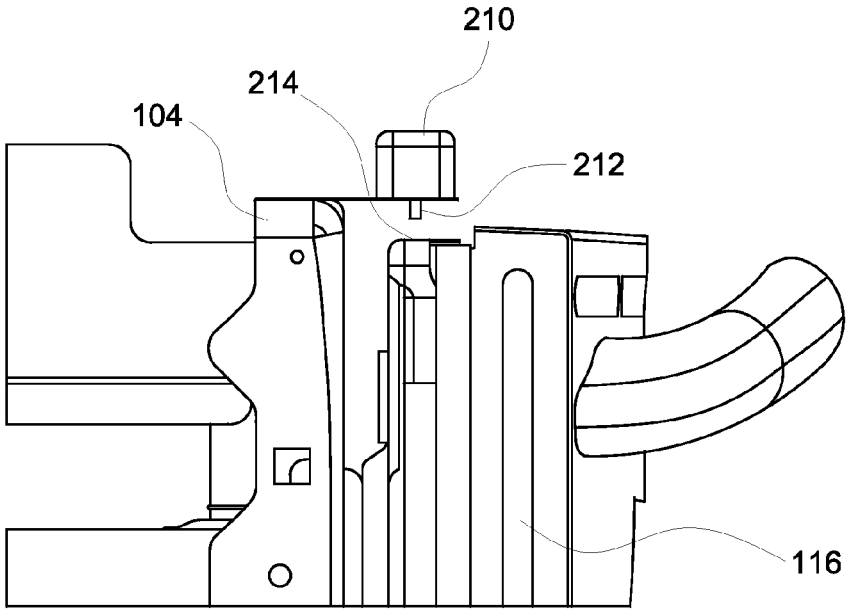
FIG. 4 is a side view of the locking mechanism illustrated in FIG. 3 in an enabled or unlocked state.
Figure 5:
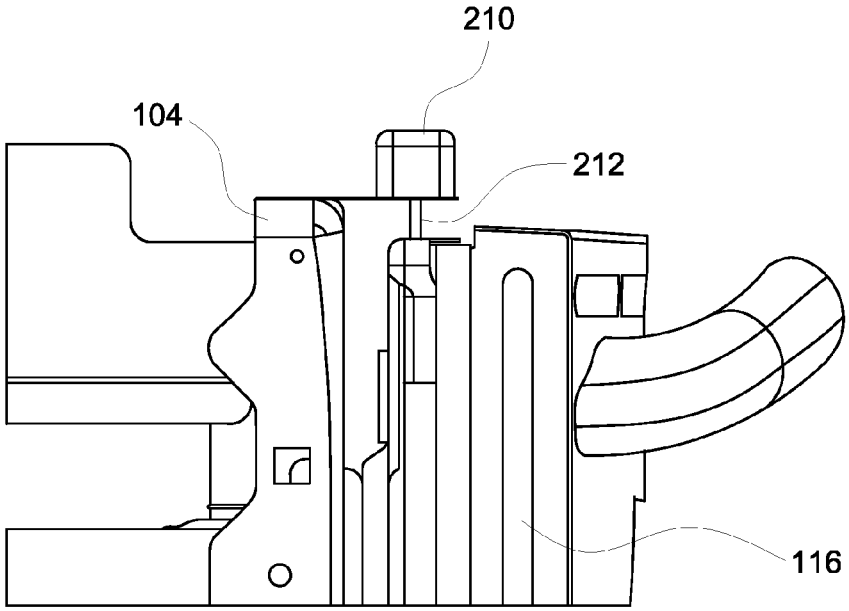
FIG. 5 is a side view of the locking mechanism illustrated in FIG. 3 in an enabled or locked state.

FIG. 4 illustrates the door locking device 210 in an unlocked state or position, with the pin 212 in a retracted position. In the example shown in FIG. 4, in the unlocked state or position, the pin 212 of the oven door locking device is maintained in a retracted position and the pin 212 does not engage the receiver 214 in the front portion 104 of the oven cabinet 102. In the example of FIG. 5, the oven door locking device 210 is in the locked state or position, and the pin 212 is in an extended position. In the extended position, the pin 212 engages the receiver 214 in the front panel 104 and the door 116 is prevented from being opened.

Generally, when the sensor 220 detects the presence of a flame or fire within the oven cavity 130, a signal is generated that causes the oven locking device 210 to engage and secure the door 116 in the closed and locked position. In a situation where the door 116 is not in the closed position when the sensor 220 detects a flame or fire, in one embodiment, the oven door locking device 210 will not attempt to engage and lock the door 116. In this case, the oven door locking device 210 can wait until the door 116 is in the closed position before attempting to secure the door 116. In one embodiment, the controller 168 of FIG. 1 is configured to detect that the door 116 is in the open position. The controller 168 can delay the transmission of the door locking enable command to be delayed until it is detected that the door 116 is in the closed position. Alternatively, the oven door locking device 210 can include a door position sensor (not shown) that does not allow the pin 212 to transition to the extended position when the door 116 is not in the closed position or the receiver 214 is not aligned or not able to receive the pin 212. In one embodiment, a suitable alarm or notification to the user can be provided informing them to close the door 116 due to the detection of a flame or fire, as well as to inform that the door 116 has been locked due to the detection of a flame.

In one embodiment, when a flame or fire is detected within the oven cavity 130, power to the oven 114, or the source of fuel, can be shut off when a flame or fire is detected. The power can include electric power, when the oven is an electric oven, or a gas supply when the oven 114 is a gas oven, or a combination of both. Generally, once it is determined that the flame is extinguished and it is safe to open the oven door 116, the oven door locking device 210 can automatically disengage the oven door 116. Alternatively, manual intervention by the user may be required to override or enable the oven door locking device 210 to disengage the oven door 116. For example, one of the switches 164 on the control panel 162 could be an oven door lock disable switch. If the sensor 220 no longer detects a flame, and/or the oven temperature is below a predetermined temperature, activating oven door lock disable switch could be enabled to allow the oven door locking device 210 to disengage the door 116 when the switch is activated. If the flame is still detected, the oven cavity temperature too high, and/or a pre-determined time after the detection of the flame has not elapsed; the oven door locking device 210 will not be allowed to disengage the door 116 in order to ensure the safety of the user.

The aspects of the disclosed embodiments make use of an ultraviolet or infrared sensor to detect a flame or fire within an interior of an oven cavity. Upon detection of the flame or fire, a locking mechanism can quickly and automatically secure the oven door in a closed position to prevent a user from opening the door and allowing fresh combustion air to feed the fire. The sensor can be mounted within the oven cavity or remotely from the oven cavity. Additionally, power and fuel sources can be disengaged or turned off. By quickly preventing the oven door from being opened, the probability of damage by an oven fire event is reduced.

Thus, while there have been shown, described and pointed out, fundamental novel features of the invention as applied to the exemplary embodiments thereof, it will be understood that various omissions and substitutions and changes in the form and details of devices illustrated, and in their operation, may be made by those skilled in the art without departing from the spirit of the invention. Moreover, it is expressly intended that all combinations of those elements and/or method steps, which perform substantially the same function in substantially the same way to achieve the same results, are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A locking system for an appliance comprising an oven and a door for the oven, the door being moveable between an open position allowing access to an interior of the oven and a closed position preventing access to the interior of the oven, the locking system comprising:

an oven door lock device selectively switchable between a locked position and an unlocked position, the oven door lock device being operative in the locked position to engage and secure the door in its closed position and in the unlocked position to permit movement of the door from its closed position;

a flame sensor configured to detect a flame within the oven;

a controller communicatively coupled to the flame sensor, the controller being configured to switch the oven door lock device to its locked position when a flame within the oven is detected; and a door position sensor coupled to the controller and configured to detect an open position of the door, the controller being configured to delay a switching of the oven door lock device to its locked position when the flame within the oven is detected and the door is in the open position.

2. The locking system of claim 1, wherein the oven door lock device is a quick release locking device.

3. The appliance of claim 1, wherein the oven door lock device is a solenoid and locking pin combination, the solenoid configured to hold the locking pin in position to secure the door in its closed position when the flame within the oven is detected.

4. The locking system of claim 3, further comprising a pin receiver in the oven door configured to receive the locking pin of the oven door lock device.

5. The locking system of claim 4, wherein the oven comprises a cabinet portion, wherein one end of the oven door lock device is secured to the cabinet portion of the oven.

6. The locking system of claim 1, wherein the sensor is an infrared or ultraviolet detection sensor.

7. The locking system of claim 1, wherein the oven comprises an oven liner defining an oven cavity and the flame sensor is mounted to the oven liner.

8. The locking system of claim 7, further comprising a light pipe extending through the oven liner into the oven cavity, and wherein the flame sensor is disposed at an end of the light pipe away from the oven cavity.

9. The locking system of claim 1, wherein the flame sensor is located remotely from the oven.

10. The locking system of claim 1, wherein the controller is configured to deactivate power to the oven when the flame sensor detects the flame.

11. The locking system of claim 1, wherein a response time of the oven door lock device is in the range of approximately 0.1-2 seconds.

* * * * *

UNITED STATES PATENT AND TRADEMARK OFFICE

CERTIFICATE OF CORRECTION

PATENT NO. : 8,800,544 B2
APPLICATION NO. : 13/008359
DATED : August 12, 2014
INVENTOR(S) : Newsom et al.

It is certified that error appears in the above-identified patent and that said Letters Patent is hereby corrected as shown below:

In the claims

In Column 6, Line 40, in Claim 6, delete "the sensor" and insert -- the flame sensor --, therefor.

Signed and Sealed this
First Day of December, 2015

Michelle K. Lee

Michelle K. Lee
*Director of the United States Patent and Trademark Office*